US005755398A

United States Patent [19]

Thompson, Sr. et al.

[11] Patent Number: 5,755,398

[45] Date of Patent: May 26, 1998

[54] WINCH DRUM UTILIZING COMPOSITE FLANGES AND METHOD OF ASSEMBLING SAME

[75] Inventors: Robert M. Thompson, Sr., Houma; John Ledet, Thibodaux; Irvin Bourg, Raceland, all of La.

[73] Assignee: Smatco Industries, La.

[21] Appl. No.: 715,762

[22] Filed: Sep. 19, 1996

[51] Int. Cl.[6] ..... B65H 75/14

[52] U.S. Cl. ..... 242/614; 242/118.4

[58] Field of Search ..... 242/614, 614.1, 242/118.4, 611.1

[56] References Cited

U.S. PATENT DOCUMENTS

| | | | |
|---|---|---|---|
| 1,306,792 | 6/1919 | Woodworth | 242/614 X |
| 1,473,681 | 11/1923 | Mossberg | 242/614.1 X |
| 1,700,313 | 1/1929 | Greve | 242/611.1 |
| 1,807,786 | 6/1931 | Hescock | 242/614 X |
| 2,058,133 | 10/1936 | Clemmons | 242/614.1 X |
| 3,591,103 | 7/1971 | Hafner | 242/614.1 X |
| 3,591,104 | 7/1971 | Hafner | 242/614.1 X |
| 5,125,590 | 6/1992 | LeCompte | 242/118.4 |
| 5,330,127 | 7/1994 | Hafner | 242/118.4 |

*Primary Examiner*—Michael Mansen

*Attorney, Agent, or Firm*—Pravel, Hewitt, Kimball & Krieger

[57] ABSTRACT

A winch drum including a barrel portion having composite flanges secured at each end. The flanges including two or more partially independent, segmented, modules with each modular section placed diametrically one on the other thus forming an expanding concentric flange. The first modular section secured to the winch drum, barrel portion having a relatively small outside diameter with respect to the barrel is treated, from a design standpoint, as the primary shear module. The second and subsequent concentric sections are only secured to the lower modular section at their outer faces and treated independently for shear and bending with each cross section being sized to accommodate the forces applicable only to that modular section thus reducing shear and bending in these modules.

17 Claims, 3 Drawing Sheets

WINCH DRUM UTILIZING COMPOSITE FLANGES AND METHOD OF ASSEMBLING SAME

BACKGROUND OF THE INVENTION:

1. Field of the Invention

The present invention relates to winches in general and more particular to an improvement in the construction of winch drum and flange assemblies.

2. General Background

It is the general practice in the winch industry to construct winch drums in the form of a spool arrangement whereby a flange is secured at each end of a barrel. Such winches are generally used to accommodate a variety of diametrical elements but most commonly associated with cabling and the like. In designing such winch drums is has been the wide spread practice to simply provide a flange at each end of a barrel with the flange and barrel designed to resist the lateral force and crushing load of the cable when being wound on the drum. In most cases a relative short length of cabling is provided to be wound or unwound from the drum. Thereby keeping the flanges at a relatively small diameter with respect to the barrel. This is necessitated as a result of the lateral forces being applied to the flanges, resulting from torsion force exerted by the cabling, exerting outwardly forces on the elements of each lower layer. In general practice such lateral forces imparted into the flanges as shear can be negated by simply providing a flange having sufficient cross section. However, in some cases where larger diameter and/or longer lengths of cabling or the like is required, necessitating larger diameter flanges, the flange cross section requirement becomes much larger. In which case gussets, reinforcing webs or trusses are generally provided around the face of the flange and the barrel thereby providing additional cross section for the flange and further transferring bending forces, imparted in the flange, back to the barrel. It is also assumed that a winch gains leverage as the subsequent layers are wound on the drum thereby reducing the torque required to turn the drum thus translating less lateral force to the flanges at the outer perimeters of the flange. Therefore, as a rule less cross section is required to resist bending and shear at the outer perimeters of a winch flange. However, in cases where loads on the cable are increased and shock loads are subject to occur at any point during the winding operation, the flanges must be capable of sustaining such loads.

In current practice, winches are being developed which are capable of containing miles of diametrical type material such as nets, rope, cables and tubular goods. In other cases very large diameter cable are utilized with very high loads. In such cases the practice of using a one piece flange attached to the barrel is no longer practical, nor is the use of trusses, reinforcing webs or gussets. In such cases a flange several feet in diameter is often required in conjunction with very wide spacing between the flanges. However, space is usually at a premium in places where such winches are used such as on offshore drilling rigs and on board ships. The radial force or torsion load on such large winches have become exceedingly large as well, often, exerting millions of pounds of lateral force or shear into the flanges. Attempts to use one piece flanges to contain such bending loads and shear forces have meet with catastrophic failure. It has further become impractical to truss or gusset such one piece flanges as a result of the lack of space required at each end of the winch and the resulting amount of weld requirement. Failure generally occurs while the winch is being utilized to retrieve cabling under great load. In such cases damage is extensive and the cost becomes enormous due to down time and replacement.

Therefore, there is a need in the winch industry for an improved winch drum having flanges capable of sustaining the enormous forces encountered in present day operations.

SUMMARY OF THE PRESENT INVENTION

The proposed winch drum construction comprising the present invention addresses the problems in the current art by providing a composite, segmented, concentric ring construction which allows the winch drum's flange cross section to be kept to a minimum without the extensive use of trusses or gussets. The improved winch drum and flange construction comprises several composite sections, each section comprising two or more parallel rings held in a spaced apart relationship by one or more circular rims with each section placed diametrically one on the other thus forming an expanding concentric flange. Each section thus having an inboard and outboard wall face. The first section being secured to the winch drum and treated, from a design standpoint, as the primary shear module. The second and subsequent concentric sections are then treated independently for shear and bending with each cross section being sized to accommodate the forces applicable to that section. Each subsequent flange section is only secured to the section directly below, at its outboard wall face. Therefore bending about the inboard weld connection of the first shear module is limited to this module only and not amplified by inboard wall faces of subsequent flange sections. Weld connections at each subsequent concentric flange section at the outboard face, may be reinforced by special shear rings at strategic points or covering each welded seam with a scab plate superimposed over the weld seam, thus further reducing shearing and bending in the upper sections.

It is therefore possible to provide very large winch drums constructed in the above manner which withstand enormous forces translated into a winch's flanges, in the form of very large lateral shear and bending forces, without catastrophic failure.

It is an object of the present invention to provide an improved winch drum and a construction process which allows for the design of exceptionally large winch drums having extremely torque and cabling capacity.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
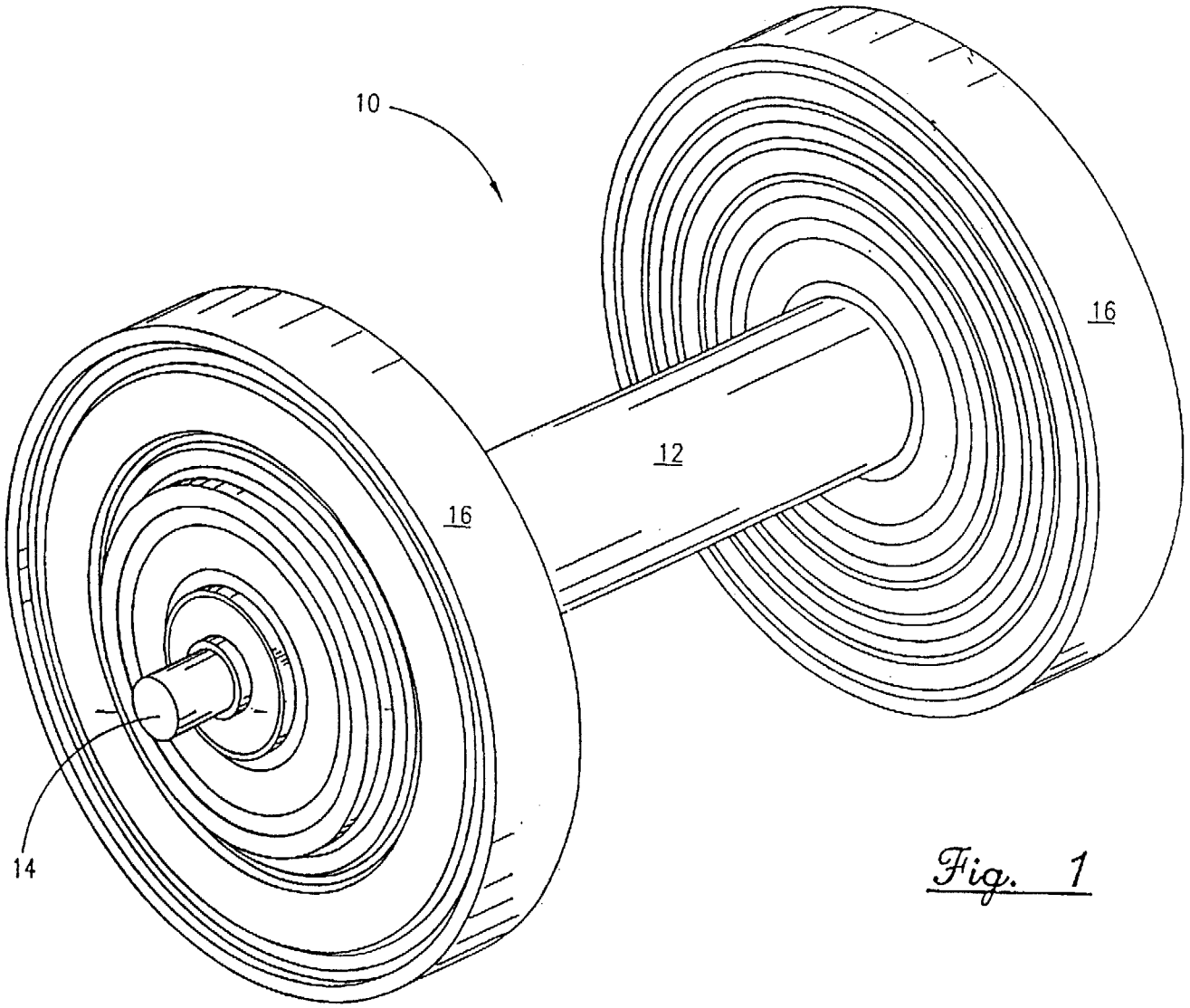
FIG. 1 illustrates the preferred embodiment of the composite structure for large winch drums of the present invention.
Figure 2:
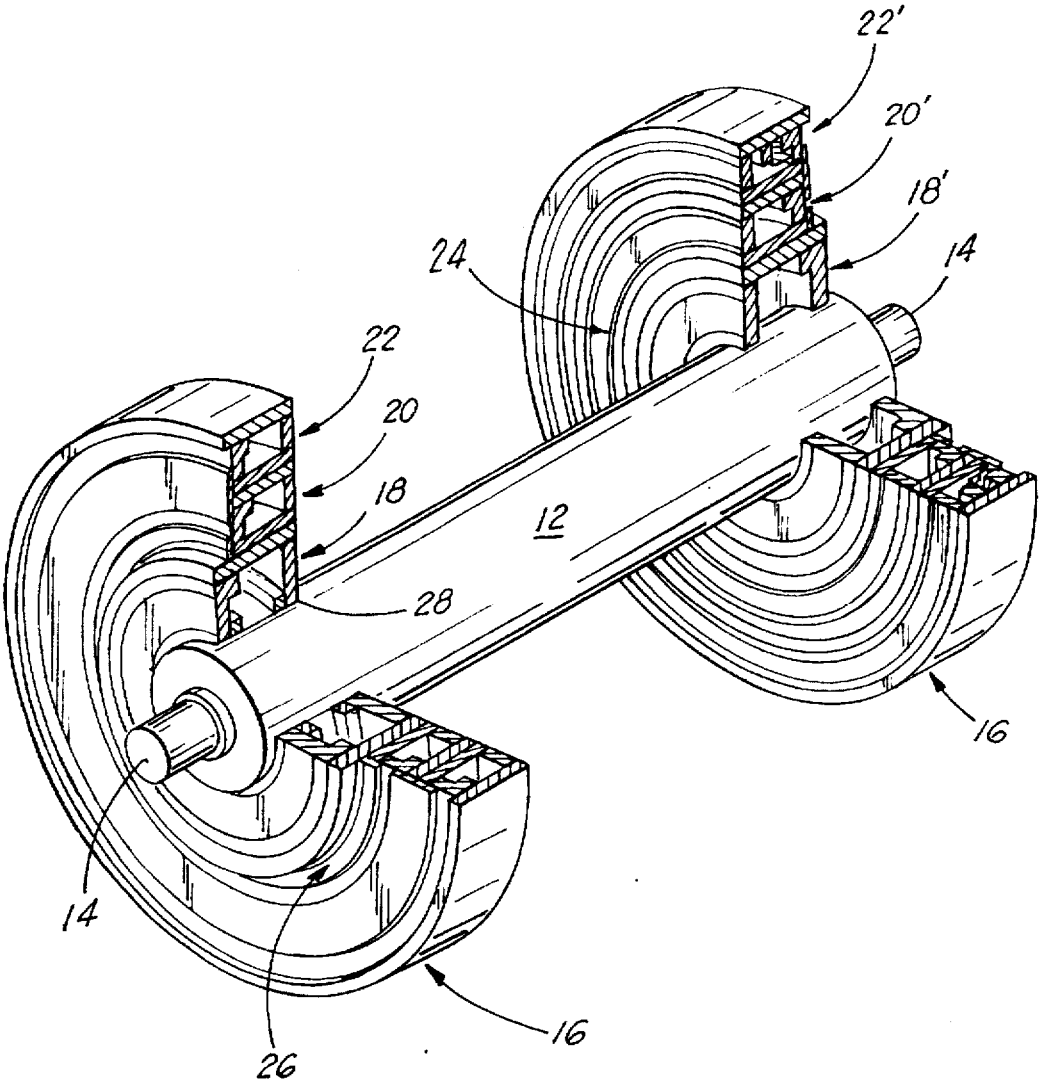
FIG. 2 illustrates a partial cut away view of each of the composite modular sections of the preferred embodiment of the present invention.
Figure 3:
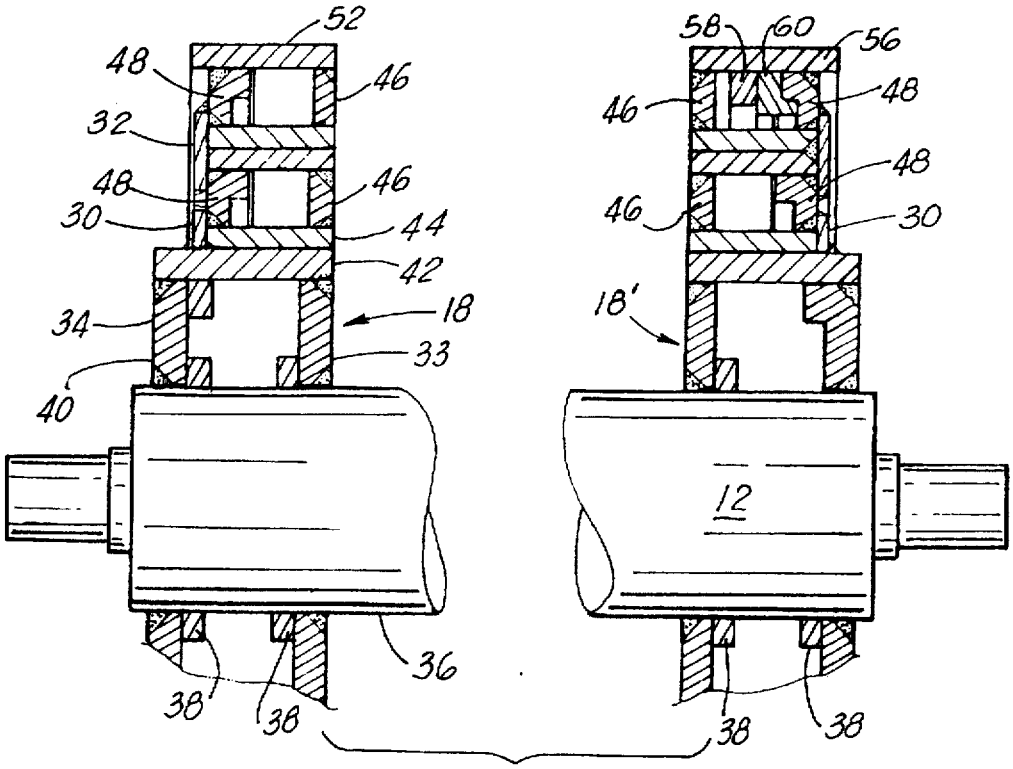
FIG. 3 illustrates a partial cut away view of the composite winch drum of the present invention.

The present invention 10 depicted in FIG. 1 comprises a composite structure for large winch drums requiring exceptionally large flanges, which are subjected to extremely high shear and bending loads. The construction process and structure of the preferred embodiment 10 as first illustrated in FIG. 1, comprises a composite, cylindrical, barrel or drum 12 concentrically secured to a central shaft 14 which extends some distance either side of the drum portion 12 which is fitted with large composite flanges 16 secured at each end, defining a space therebetween for winding cable or the like. Each flange 16 comprises several composite modular sections, as best seen in FIG. 2. The first module 18 is welded directly to the drum or barrel portion 12 with each subsequent section or cincture 20, 22 placed diametrically around the lower one thus expanding each flange 16 in a concentric manner. Each modular section thus having an inboard 24 and outboard 26 wall face. The first modular section 18 being secured to the composite barrel or drum portion 12 of the winch drum 10 is treated from a design standpoint, as the primary shear module. The second 20 and subsequent 22 concentric modular sections are then treated independently for shear and bending with each modular cross section being sized to accommodate the forces applicable to that section. Subsequent flange modular sections 20,20', 22,22' are only secured to the modular section directly below it, at their outboard 26 wall face. Therefore, allowing the inboard wall 24 of each modular section to be subjected to flexure within their structural elastic limits thus the inboard weld connection of the first shear module 18,18' is limited to this module only and not amplified by the inboard wall face 24 of subsequent modular sections 20,20', 22,22' Weld connections at each subsequent concentric. sections 20,20', 22,22, at their outboard face 26, may be reinforced by adding shear rings 30 or doubling plates 32 in the manner shown in FIG. 3. The first modular section is comprised of inboard and outboard vertical rings 33, 34 welded directly to the face 36 of the cylinder barrel portion 12 in a parallel, spaced apart manner as illustrated in FIG. 3. Additional rings 38 of any required cross section may be added as necessary to resist the shear forces 50 shown exerted on the modular section 18 in FIG. 4 by cabling under high tension being wrapped on the drum. Web plates 41 may also be inserted as spacers, at intervals around the rings, between the inboard and outboard vertical rings 33,34 to resist trapezoidal bending of the modular section 18 and further impede shearing . Additional rings 40 may also be used as weld backing plates, at large complete penetration welds, which also tend to further reduce bending or the modular section. Such rings 40 may be separate pieces or integral with the inboard or outboard vertical rings 32,34. A horizontal rim member 42 completes the modular section by being attach to the periphery of both the inboard and outboard vertical rings 32, 34. The first modular section is usually kept proportionally small, thus keeping bending and shearing stresses to a minimum.

The second and subsequent modular sections 20, 20', 22, 22' are generally constructed in a similar manner as the first modular section except for a second horizontal rim member welded to each of the inboard and outboard vertical rings 46, 48 at their inside diameter. The width of the second 20, 20' and subsequent modules 22, 22' may be varied as stress on the inboard faces 24 diminishing with seceding layers of cable or other such diametrical material is wound onto the drum 10. In such cases the second module is reinforced with the addition of a shear ring 30 welded to the rims 42, 44 of both the first and second modules overt the outboard connection. As stated above, the joint between these two rim members is not welded at the inboard face 24 nor is the joint between the second or any subsequent modules. The subsequent modules are only welded to each other at the outboard rim joints.

Figure 4:
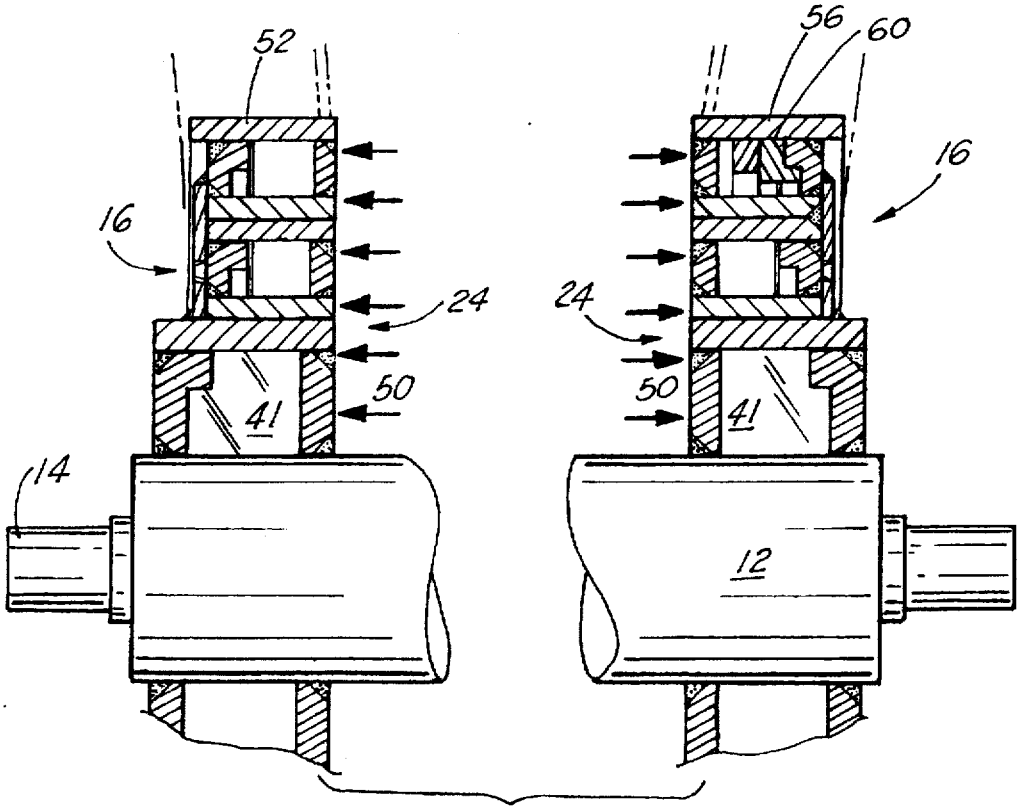
FIG. 4 illustrates a partial cut away view of the composite winch drum undergoing stresses while cable is being wound thereupon in the preferred embodiment of the present invention.

The outer most module, usually is faced with a heavy rim member 52, 56 either of which may be utilized as a brake rim. In which case the rim may be reinforced by a ring 58 attached to the under side of the rim 56 to help prevent bending. The ring 58 may also be stabilized by web plates 60 attached at intervals around the ring between the reinforcing ring 58 and the outboard ring 48. As seen in FIG. 4, by welding the second and subsequent sections 20, 22, to each other and to the first section only at the outboard face 26, each module becomes a stand alone entity. With the highest forces 50 being absorbed by the first module, no bending moment on the inboard faces 24 is transferred to the second and subsequent modules 20, 22. Likewise no bending moment is transferred from the second module inboard face to subsequent modules. Therefore, all flexural force in each module is translated into shear directed to the outboard face 26. The outboard face 26 is then reinforced to resist any bending or shear through heavier composite cross sections or doubling plates 30, 32.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not intended to limit the invention.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A winch drum comprising:

a) a barrel portion;

b) a composite flange located at each end of said barrel portion defining a space therebetween for winding cable and the like; and c) each said composite flange further comprising;

i) at least a first composite cincture, secured to said barrel portion;

ii) at least a second composite cincture secured to the periphery of said first composite cincture; and iii) said first and second composite cinctures, each having inboard and outboard faces, said cinctures secured to one another along their respective outboard faces, so that the inboard faces are allowed to flex apart from one another against axial forces.

2. A winch drum according to claim 1 wherein said first composite cincture comprises a plurality of parallel rings held spacedly apart by at least one spacing member secured to at least two said parallel rings.

3. A winch drum according to claim 2 wherein said second composite cincture comprises a plurality of parallel rings held spacedly apart by at least one said rim member secured to at least two said parallel rings.

4. A winch drum according to claim 1 wherein said composite flange is comprised of a plurality of composite cinctures, each concentrically attached contiguous the periphery of each adjacent cincture in a manner expanding diametrically from said barrel portion.

5. A winch drum according to claim 4 wherein said composite cinctures comprise inboard and outboard faces, said inboard face being adjacent said space for winding cable.

6. A winch drum according to claim 5 wherein said composite flange further comprise at least one plate superimposed across adjoining cinctures at point of attachment.

7. A winch drum comprising:

a) a barrel portion;

b) a composite flange on each end of said barrel defining a space therebetween upon which cabling or the like may be received;

c) each composite flange further comprising:

i) a first composite annulus fixedly attached to said barrel portion;

ii) a second composite annulus secured to the outer periphery of said first composite annulus;

iii) a third composite annulus secured to the outer periphery of said second composite annulus; and iv) said first, second and third composite annuli having inboard and outboard faces, and at least two of the annuli secured to one another along their outboard faces, so that the inboard faces are allowed to flex apart from one another against axial forces.

8. A winch drum according to claim 7 wherein said first composite annulus comprises a plurality of parallel rings held spacedly apart by at least one spacing member secured to at least two said parallel rings.

9. A winch drum according to claim 7 wherein said second composite annulus comprises a plurality of parallel rings held spacedly apart by at least one said rim member secured to at least two said parallel rings.

10. A winch drum according to claim 7 wherein said third composite annulus comprises a plurality of parallel rings held spacedly apart by one said rim member secured to at least two said parallel rings.

11. A winch drum according to claim 10 wherein said third composite annulus comprises inboard and outboard faces, said inboard face being adjacent said space for winding cable and whereas said annuli are secured to each other by attachment at said outboard face.

12. A winch drum according to claim 11 wherein said composite flange further comprise at least one plate superimposed across adjoining annulus at point of said attachment.

13. A winch drum construction process comprising:

a) constructing a tubular member;

b) constructing a composite flange comprising:

i) a first composite cincture, comprising a plurality of rings held spacedly apart by a spacing member attached to at least two of said rings thus forming a composite element having inboard and outboard faces;

ii) a second composite cincture secured to the periphery of said first composite cincture comprising a plurality of rings held spacedly apart by at least one spacing member attached to at least two of said rings thus forming a composite element having inboard and outboard faces; and iii) a ring member attached peripherally to said second composite cincture;

c) securing said first and second cinctures to one another at said outboard faces so that the inboard faces are allowed to flex apart from one another against axial forces;

d) reinforcing attachments in a manner which reduces shear and bending by providing shear rings and plates at point of attachment; and e) securing one said composite flange to each end of said tubular members defining a space therebetween upon which cabling or the like may be wound.

14. A winch drum construction process according to claim 13 further including the step of attaching said first composite cincture to said barrel so that said cincture is substantially non-flexing against lateral forces exerted by layering of cable or the like being wound on said barrel under heavy load conditions.

15. A winch drum construction process according to claim 14 also including attaching said second composite cincture and any subsequent cinctures to adjacent composite cinctures so that each composite cincture reacts independently with respect to shear and bending forces.

16. A winch drum construction process according to claim 15 wherein said process further includes securing subsequent composite cinctures to said first composite cincture so that all lateral forces exerted on an inboard wall of said second and said subsequent composite cinctures, positioned adjacent said cable and space defined therefor, are directed to an outboard wall of said cinctures opposite said cable, and reducing bending on each composite cincture caused by bending forces acting on first composite cincture.

17. Method of constructing a winch drum having composite flange members comprising the steps of:

a) providing a hollow cylinder portion having first and second ends, and a continuous surface for winding cable and the like;

b) securing composite flange members at said first and second ends of said hollow cylinder, thus defining a space therebetween for winding said cable and the like around said hollow cylinder, said composite flanges having inboard and outboard faces with said inboard face adjacent said cable;

c) constructing said composite flange members comprising at least two composite ring portions, fitted diametrically one over the other, comprising a plurality of spaced apart rings having spacers therebetween;

d) securing said flange members to one another only at said outboard faces;

e) reinforcing said composite flange members at point of attachment by adding at least one additional ring member in a manner which further reduces shear and bending imparted to said inboard face of said flanges members as a resultant of axial force induced by strain on said cable;

f) constructing said composite flange in a manner whereby a first said ring portion adjacent said hollow cylinder being smaller in outer diameter than adjacent ring portions is further secured to said hollow cylinder in a manner whereby upon receiving high axial loads imparted by said cable and the like being wound upon said hollow cylinder, said first ring portion resist said loading sufficiently to prevent bending and shearing; and g) constructing said composite flange in a manner whereby a second and subsequent ring portions, secured diametrically to said first ring portion, are allowed to deflect independently, within allowable structural limits, as resultant of axial loading, on said inboard faces of said flange members, imparted by said cable or the like.

* * * * *